US007586099B2

(12) United States Patent
Eyhorn et al.

(10) Patent No.: US 7,586,099 B2
(45) Date of Patent: Sep. 8, 2009

(54) VACUUM PLASMA GENERATOR

(75) Inventors: Thorsten Eyhorn, Freiburg (DE); Moritz Nitschke, Freiburg (DE); Peter Wiedemuth, Herbolzheim (DE); Gerhard Zahringer, Freiburg (DE)

(73) Assignee: HUETTINGER Elektronik GmbH + Co. KG, Freiburg (DE)

( * ) Notice: Subject to any disclaimer, the term of this patent is extended or adjusted under 35 U.S.C. 154(b) by 103 days.

(21) Appl. No.: 11/396,354

(22) Filed: Mar. 30, 2006

(65) Prior Publication Data

US 2007/0241287 A1 Oct. 18, 2007

Related U.S. Application Data

(60) Provisional application No. 60/667,217, filed on Apr. 1, 2005.

(30) Foreign Application Priority Data

Mar. 30, 2005 (EP) ..... 05006876

(51) Int. Cl.
*H01J 27/00* (2006.01)

(52) U.S. Cl. ..... 250/423 R; 315/111.51; 315/111.21; 204/192.15; 219/121.43; 219/121.36; 219/121.54; 219/121.41; 156/345.1; 156/345.35; 156/345.38; 156/345.44; 156/345.48; 361/18; 361/690; 330/251; 330/207; 714/763; 427/445; 118/723

(58) Field of Classification Search ..... 250/423 R; 156/345.1, 345.35, 345.38, 345.48, 345.44; 361/18, 690; 330/251, 207; 714/763; 219/121.57, 219/121.36, 121.54, 121.41; 315/111.21; 427/445; 118/723
See application file for complete search history.

(56) References Cited

U.S. PATENT DOCUMENTS

2006/0196426 A1 * 9/2006 Gluck et al. ..... 118/723 R

FOREIGN PATENT DOCUMENTS

DE 298 19336 4/1999

(Continued)

OTHER PUBLICATIONS

Office Action from corresponding Japanese Application No. 2006-93552, dated Feb. 6, 2009, 9 pages (English translation attached).

*Primary Examiner*—Jack I Berman
*Assistant Examiner*—Meenakshi S Sahu
(74) *Attorney, Agent, or Firm*—Fish & Richardson P.C.

(57) ABSTRACT

A vacuum plasma generator (VPG) includes an output connector for electrical connection of the VPG to at least one electrode of a plasma chamber. The VPG includes a mains connector for connection of the VPG to a mains power supply, a mains input filter coupled to the mains connector, a voltage converter coupled to the mains input filter for generating an output signal, a voltage converter control input for connection to a voltage converter control, a shield that surrounds at least the voltage converter, the mains power supply, and the mains input filter, and a connection device that provides an electrical connection between the shield and the plasma chamber.

42 Claims, 3 Drawing Sheets

FOREIGN PATENT DOCUMENTS

| | | |
|---|---|---|
| DE | 102 30726 | 7/2004 |
| DE | 103 06347 | 8/2004 |
| JP | 6215894 | 8/1994 |
| JP | 7011430 | 1/1995 |
| JP | 2000286246 | 10/2000 |
| JP | 2002530856 | 9/2002 |
| JP | 2003318162 | 11/2003 |
| JP | 2004080846 | 3/2004 |
| JP | 2004229401 | 8/2004 |
| JP | 2005076054 | 3/2005 |
| WO | WO 00/30148 | 5/2000 |
| WO | WO 03/079397 | 9/2003 |

* cited by examiner

VACUUM PLASMA GENERATOR

CROSS REFERENCE TO RELATED APPLICATION

This application claims priority under 35 U.S.C. §119 to EP 05 006 876.6, filed on Mar. 30, 2005, and to U.S. Provisional Application No. 60/667,217, filed on Apr. 1, 2005. The subject matters of all of these applications are hereby incorporated by reference in their entireties.

TECHNICAL FIELD

The invention relates to a vacuum plasma generator (VPG) having an output connector for electrical connection of the VPG to at least one electrode of a plasma chamber.

BACKGROUND

Vacuum plasma generators are known to have various power ratings and to provide various signal output forms. In vacuum glass coating, for example, generators having DC output and medium frequency (MF) output with power ratings between 30 and 300 kW are used. The MF signal at the output of the generator is in most cases a sine signal with frequencies between 10 kHz and 200 kHz. In this case, the output voltages can be from several 100 V to more than 1000 V. For ignition of the plasma, the output voltages from the generators are often higher than in normal operation.

Vacuum plasma generators can also generate signals that can interfere with the functioning of other devices within the vacuum plasma system. For example, voltage converter circuits within the vacuum plasma generator can cause harmonics on a mains input connector that feeds the vacuum plasma generator. These harmonics, in turn, couple, through a mains connector and a mains power supply, to other devices in the vacuum plasma system and can interfere with these other devices.

High-frequency interference can occur on an output connector of the VPG upon ignition of the plasma. In this case, the cables, that is, the connection cables from the output of the VPG to electrodes of the plasma chamber, the cables for remote control of the VPG, and the cables of the mains supply, act as antennae that radiate high frequency (HF) power generated by the VPG. Depending on the length of the output cable between the VPG and the plasma chamber, such HF interference can be emitted into and captured from the surroundings, and therefore interfere with the functioning of other devices in the plasma system.

The cables also act as receiving antennae, that is, they also capture HF power and couple it into the VPG and may in that manner interfere with its operation. Here too, the length of the conductors and the frequency of the interference are factors that can impact the level of interference. Interference can also be coupled into the VPG directly from the mains power line. Additionally, there are also voltage surges, voltage sags, and also momentary interruptions in the mains power supply that can adversely affect the functioning of the VPG.

A high-power, medium-frequency generator for plasma systems is described in German Utility Patent DE 298 19 336 U1, in which the vacuum plasma generator is divided into a mains power supply part and an oscillator arrangement, and the oscillator arrangement is matched to the external geometry of the coating chamber, and is mechanically and electrically connected directly to a magnetron disposed in the plasma chamber.

SUMMARY

The invention provides vacuum plasma generators that reduce the impact of interference caused by electromagnetic radiation from the surroundings, and release as little radiation as possible into the surroundings. Moreover, if interference leads to failure or temporary interruptions, the vacuum plasma generators can indicate such detrimental conditions.

In one general aspect, the invention features vacuum plasma generators (VPG) that have an output connector for electrical connection of the VPG to at least one electrode of a plasma chamber. The VPG includes a mains connector that connects the VPG to a mains power supply, a mains input filter coupled to the mains connector, a voltage converter coupled to the mains input filter for generating an output signal, a shield that surrounds at least the voltage converter, and a connection device for electrical connection of the shield to the plasma chamber.

Implementations can include one or more of the following features. For example, the connection device can be configured for connection of the shield to the plasma chamber such that the size of the shield is matched to the size of the plasma chamber.

The vacuum plasma generator can include an outer housing having a connection device that connects to an electrode holder of the plasma chamber. The connection between the electrode holder of the plasma chamber and the housing can include a mechanical connection and/or an electrical connection. The housing can include the shield. The housing can be matched to the external shape of the electrode holder by way of the connection device. The housing can be matched to the external shape of the electrode holder and can include connection elements for mounting directly to the electrode holder.

In various embodiments, the mains input filter can be connected to the shield, and the vacuum plasma generator can include a protective ground conductor connector that is connected to the shield. The mains input filter can be connected to the shield by way of a low impedance to high frequency connection.

The shield can include a connector for linking to a connector on the electrode holder of the plasma chamber. The connection between the shield and the electrode holder connector can be a low impedance to high frequency connection. In certain embodiments, the vacuum plasma generator can include a connector device for mechanical connection to the plasma chamber. The connection device between the shield and the plasma chamber forms a low impedance to high frequency connection between the shield and an electrode holder of the plasma chamber.

In other embodiments, the vacuum plasma generator can include an electrical connection between the output connector to at least one electrode of the plasma chamber. The electrical connection can be short enough to reduce interference between the plasma chamber and external signals. The electrical connection can be shorter than about 2 meters.

The voltage converter control can be in the form of a digital control and can include a programmable digital logic device.

The vacuum plasma generator can include at least one connector for a digital remote control line. The connector for the digital remote control line can be linked to the voltage converter control. The connection between the digital remote control line connector and the voltage converter control can include a filter that is connected to the shield with low impedance to high frequency. The filter can suppress interference from entering and exiting the vacuum plasma generator. The connection of the connector for the digital remote control line to the voltage converter control can include a galvanic isolation device. The connector for the digital remote control line can be an optical connector and the digital remote control line can include an optical waveguide. The connector for the digital remote control line can be bidirectional and data transfer to and from the voltage converter control through the remote control line can be provided through the connector.

The vacuum plasma generator can include a connector that couples to external analog remote control signals and an A/D converter within the shield and connected to the connector for digitizing the external analog signals. The A/D converter can be connected to the voltage converter control.

The vacuum plasma generator can include a measuring device that monitors output quantities of the output connector. The measuring device can be disposed inside the shield and is configured to digitize the output quantities and pass them to the voltage converter control. The measuring device can include one or more filters that are configured to suppress high-frequency interference.

The vacuum plasma generator can include a transformer that provides galvanic isolation between the main connector and the output connector.

The vacuum plasma generator can include a converter connected downstream of the mains rectifier. The converter can include a converter control input for connection to a converter control and the output of the converter is connected to the voltage converter. The converter can include a boost converter, a buck converter, or both a boost converter and a buck converter. The converter control can be integrated in the voltage converter control.

The voltage converter can include an inverter that generates a pulse-shaped alternating current voltage, and a resonant circuit that is connected downstream of the inverter and that converts the pulse-shaped voltage into a sinusoidal voltage.

The vacuum plasma generator can include an error condition diagnosis device and an indicating device that indicates error conditions. The vacuum plasma generator can include a memory in which the error conditions may be stored and read out for diagnostic purposes and indicated on the indicating device or read out by way of remote control line connectors. The error condition diagnosis device can be integrated in the voltage converter control and the digitized data of the measuring device can be fed to the error condition diagnosis device.

In certain embodiments, the voltage converter can include a voltage converter control input for connection to a voltage converter control. In some implementations, the connection device can be a low impedance to high frequency connection. The shield can be a metallic housing.

To further improve the interference immunity, the mains input filter, the voltage converter control and, where applicable, further elements of the vacuum plasma generator, may each have a shield. In other embodiments they are surrounded by a common shield that also surrounds the voltage converter.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DESCRIPTION OF DRAWINGS

Like reference symbols in the various drawings may indicate like elements.

DETAILED DESCRIPTION

Figure 1:
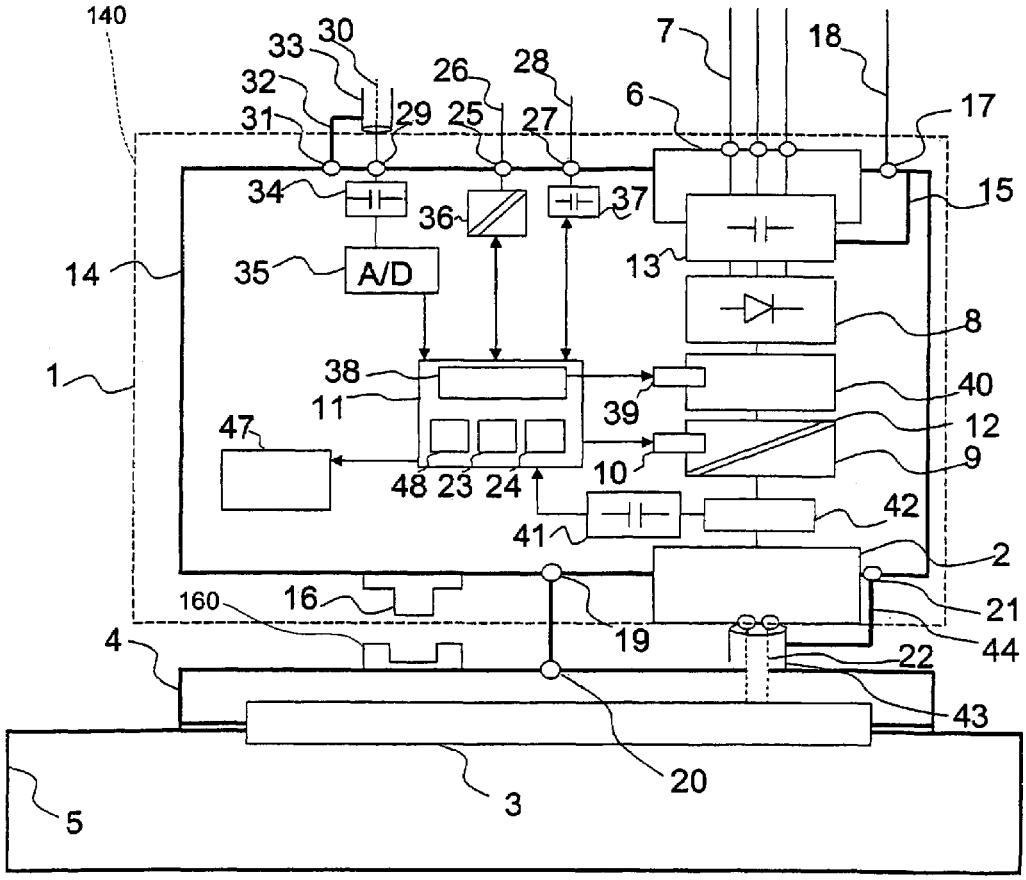
FIG. 1 is a schematic diagram of a first embodiment of a vacuum plasma generator with a plasma chamber.

The following description relates to vacuum plasma generators (VPGs) that reduce the impact of interference caused by electromagnetic radiation from the surroundings, and release as little radiation as possible into the surroundings. Moreover, if interference leads to failure or temporary interruptions, the vacuum plasma generators can indicate such detrimental conditions.

General Principles

The new VPGs described herein reduce the impact of interference in several ways. First, the VPGs include a shield that houses components of the vacuum plasma generator to prevent interference from entering or leaving the vacuum plasma generator. Second, the VPGs are designed with a shape and size that complements the shape and size of the plasma chamber to which it is coupled. Such a design reduces the impact of the external coupling between the VPG and the plasma chamber. For example, such a design reduces the length and size of the cables that couple an output of the VPG to the plasma chamber.

Another feature of the new VPG is a mains input filter coupled to a mains connector. The mains input filter protects against high-frequency interference from the mains power supply and from the surroundings which are coupled into the mains power line, that is to say, the connection line between the mains connector of the VPG and the mains power supply. The mains input filter also attenuates interference from the generator and prevents the possibility of its leading on the mains power lines to interference in the mains power supply and being radiated into the surroundings from the mains.

It is possible to ensure that interference from the surroundings does not radiate into components that are downstream of the mains input filter if at least the voltage converter, and preferably all the components that are connected downstream of the mains input filter, are shielded. For that purpose, at least the voltage converter, and preferably all the components, are disposed inside the shield. The input line or lines between the mains connector and the mains input filter should be very short, or if that is not possible, they should be shielded.

A shield in the form of a metallic housing not only offers protection against mechanical loads, but also protects against high frequency radiation from the surroundings and also protects the surroundings against high frequency radiation. Because filters carry away the high frequency power that they filter, such filters generally require a fixed ground potential. Thus, if the shield is metallic, it can provide such a ground potential. For that reason, an electrical connection, in particular a low impedance to high frequency connection, is preferably provided between the mains input filter and the shield.

A low impedance to high frequency connection is a connection of two contact points that is of low impedance (for example, <1 ohm) to high-frequency currents (for example, >1 kHz, especially, however, over 1 MHz). It may, for example, be a wide, flat conductor with wide, flat connectors at the contact points. Such a connection is also of low impedance to low-frequency currents. A low impedance to high frequency connection can be a capacitor, having wide, flat connectors at the contact points, for example, an a.c. short circuit. Such a connection is of high impedance to low-frequency currents, which may be desirable in individual cases. Another term for such connections is low-inductance connection.

The shield can have a connection to the rest of the system, that is, to the plasma chamber, and that connection can be, for example, of low impedance to high frequency. The connection can be obtained by means of as short as possible and as wide as possible a connection to the vacuum plasma system, for example to the plasma chamber. For example, the VPG can be placed directly on top of or in immediate proximity to the vacuum plasma system or the plasma chamber. The entire vacuum plasma generator can be mounted on top of the electrode holder of the plasma chamber. For that purpose, the VPG in its entirety has connection elements for mechanical connection to the plasma chamber.

Advantageously, the connection elements for mechanical connection also form the low impedance to high frequency connection. As many connection elements as possible, arranged as close together as possible, improve the high-frequency contact to the rest of the system. A wide, flat connection secured by a multiple number of connection elements and where appropriate, in addition, by spring contacts is advantageous. First, an especially low-impedance connection is formed in that manner and, second, an especially short connection line between the electrodes and the generator is obtained in that manner. This connection minimizes or reduces susceptibility to interference and the radiation of interference.

An especially large number of advantages are obtained with that construction in the case of high output ratings, for example, in the case of output ratings greater than 30 kW, since in that case the radiation of interference also increases with increasing output voltage. Other possible sources of interference remaining are through the mains connector and through the control lines that are connected to the generator. The mains connector cannot be dispensed with, and therefore interference is suppressed or reduced here with a suitable mains input filter described above.

The electrodes of the plasma chamber may be fastened to an electrode holder. The electrode holder and the electrodes are regarded as part of the plasma chamber. The vacuum plasma generator may be mechanically connected to the electrode holder such that the vacuum plasma generator and the electrode holder may together be fastened to and detached from the rest of the plasma chamber. The connection device of the generator to the plasma chamber can therefore correspond to the connection elements for connecting the generator to the electrode holder. The connection device can form the low impedance to high frequency connection of the shield to the plasma chamber, for example, to the electrode holder. The dimensions of the VPG in its entirety can be matched to the dimensions of the electrode holder.

Often, a plurality of electrode holders in a vacuum plasma system lie directly parallel to and beside one another with a typical width of approximately 80 cm. If each electrode holder is associated with one VPG, and ideally is to be mounted directly thereon, it is advantageous if each VPG does not exceed the width and the length of an electrode holder. In the case of a VPG mounted on top of the electrode holder, matched size refers to the dimensions of the face of the VPG lying on the electrode holder.

The height of the VPG is governed by the requirements of the system as to overall height. If the generator is not to be mounted directly on top of the electrode holder, for example, because changing of the electrodes takes place far more frequently than changing of the unit formed by electrodes, electrode holder, and VPG, then the VPG can be mounted in immediate proximity, with as. short as possible a connection of the shield to the plasma chamber. In the case of mounting beside or in immediate proximity to the plasma chamber, the width can be matched so that, even when electrode holders are mounted side by side very close to one another, it is possible for a VPG to be mounted in immediate proximity for every electrode holder, and when the electrode holder is changed together with the electrodes, the VPG can also be changed at the same time.

By using a mains rectifier, the mains power supply may be an a.c. voltage network having various frequencies, for example, about 50 or 60 Hz. Harmonics on the mains are rectified by the mains rectifier, and do not lead to interference in the generator. The mains power supply may also be a d.c. voltage network, for example, in the case of a d.c. voltage network, protection against reverse connection is obtained with the mains rectifier. Advantageously, rectification with harmonic suppression, so-called power factor correction (PFC), is used for harmonics to be produced as little as possible on the mains power supply. Such harmonic suppression may also be included upstream or downstream of the mains rectifier.

If control lines and other supply or delivery lines are also shielded and/or provided with input filters, the VPG in its entirety is optimally protected against interference.

The shield can have a connector for a low impedance to high frequency connection to a connector at the vacuum plasma system, for example, to the electrode holder, which in turn is connectable to the vacuum plasma system with low impedance to high frequency. The vacuum plasma generator can be mounted directly on the electrode holder and thus connect the shield to the electrode holder at as many points as possible. The shield can be matched in its dimensions to the external shape or geometry of the plasma chamber. It is then possible to achieve especially good electrical and/or mechanical contact.

If the plasma generator is fixedly connected to the electrode holder in one unit, and is capable of being replaced together with the electrode holder on the vacuum plasma system or plasma chamber, the low impedance to high frequency contacts are retained and offer good protection against interference also after the electrode/generator unit has been changed.

In some embodiments, an electrical isolation device (such as a galvanic isolator) is provided between mains connector and output connector. This serves the purposes of interference-free operation and safety. The isolation device prevents or reduces the formation of ground loops that can be a cause of interference being coupled in. In particular, the isolation device should form an effective separation or attenuation for high-frequency signals, that is to say, for frequencies distinctly greater than the operating frequency of a medium-frequency generator (for example, about 10-500 kHz). In that manner, the useful frequency can be transmitted, but any high-frequency interference is appropriately suppressed.

The shield can be connected to a protective ground conductor in order to ensure safety for operators and maintenance personnel. With an especially low-impedance protective ground conductor connector, low-frequency interference in the range of up to 10 kHz can be effectively attenuated.

The output connector can have a further connector for shielding for the electrical connection of the output connector to the at least one electrode, which shielding is connected to the shield with low impedance to high frequency. In that manner, it is possible for interference to be effectively suppressed.

The shield can be "HF-proof," that is, it lets in as little HF radiation as possible and lets out as little HF radiation as possible. This is achieved, for example, by a completely-enclosing metallic housing having openings that are as small as possible, in particular having no gaps that are longer than and no openings that are larger than one tenth of the wavelength of the frequency that is to be attenuated. The higher the frequency that is to be attenuated, the smaller the wavelength, and the smaller the openings in the housing should be. For example, the shield can have housing doors or detachable openings with spring contact strips that are connected to the shield or the metallic housing. In the case of openings for ventilation, perforated plates having small holes are to be preferred to ventilation slots.

The electrical connection of the output connector to the at least one electrode of the vacuum plasma system or the plasma chamber can be as short as possible, for example, shorter than 2 m. In this way, little interference will pass into the surroundings or be captured from the surroundings.

In certain embodiments, the control of the VPG, for example, the voltage converter control, is digital and has a programmable digital logic device. Digital controls are especially insensitive to interference from the surroundings and operate especially reliably.

The VPG can have a connector for a digital remote control line. Digital remote controls have an especially good signal-to-noise ratio and are very insensitive to interference fields. In addition, error detection data may be sent at the same time on a digital remote control line, and therefore interference can be detected and the defective data can be requested again.

The connector for the digital remote control line can include a connector for shielding that has a low impedance to high frequency connection to the shield. In that manner, it is possible for interference to be further suppressed.

The connector for a digital remote control line can have a connection to the voltage converter control. The data can thus be directly transferred into the control of the voltage converter. The connection can have a filter for suppressing interference from the surroundings into the generator and from the generator into the surroundings. A low impedance to high frequency connection of the filter to the shield can be provided. In that manner, further suppression of interference is facilitated.

The connection of the connector for a digital remote control line to the voltage converter control can have a galvanic isolation device that can prevent ground loops, which may be a further cause of interference being coupled in.

The connector for the remote control line can be an optical connector for the use of optical waveguides. Optical guides completely prevent electromagnetic interference from being coupled in and out, and therefore offer good protection.

Data transfer to the voltage converter control and from the voltage converter control can be possible over the remote control line if the connector for the remote control line is bidirectional. Digital closed-loop control can be provided. A plurality of vacuum plasma generators disposed on the plasma chamber can be centrally controlled by open-loop and closed-loop control. In particular, it is also possible in that manner for the central control to be advised of error conditions.

The VPG can have a connector for external analog signals for remote control of the generator and an internal analogue-to-digital converter (A/D converter) for digitizing the external analogue signals. Control quantities can be transferred to the VPG from a central control. The VPG is able to further process the quantities digitally, and hence in a manner insensitive to interference, and advantageously supply those quantities to the voltage converter control.

The connector for external analogue signals also can have a connector for shielding that has a low impedance to high frequency connection to the shield.

The vacuum plasma generator can have a measuring device for monitoring the output quantities, such as output voltage, output current, and/or output power, which can be disposed inside the shield. The measuring device can digitize the output quantities and pass the digitized quantities to the voltage converter control. In that manner, the output quantities can be controlled in a closed loop, indicated by the indicating device, passed to the digital remote control, and also evaluated and stored for diagnostic purposes. Moreover, erroneous measurements can be avoided if the measuring device has filters for suppressing high-frequency interference.

The vacuum plasma generator can have a transformer with low-capacitance coupling for galvanic isolation. Transformers transmit high powers with high efficiency. For that reason, transformers can be used for galvanic isolation in power generators. These transformers should have a low-capacitance coupling, for example, a coupling capacitance smaller than about 1 nF. The capacitive coupling is produced by the coupling between primary winding and secondary winding of the transformer. To keep the coupling as low as possible, the primary winding and the secondary winding are suitably spaced from each other, for example, by at least about 5 mm. The transformer can also have capacitive shielding between the primary and the secondary side, and such shielding can have a connection to the shield.

The VPG can have a converter that is connected downstream of the mains rectifier and a converter control input for connection of a converter control. At its output, typically a controllable d.c. voltage is obtained and that d.c. voltage is supplied to the voltage converter. In that manner, it is possible to compensate for voltage surges and voltage sags on the mains and for momentary interruptions in the mains power supply. Consequently, the VPG is able to continue operating without interference at the output despite the interference at the mains input.

The converter can have a boost converter and/or a buck converter. In that manner, the controllable d.c. voltage can be set regardless of whether the mains voltage is above or below the d.c. voltage. The desired d.c. voltage is also set.

The converter control can be integrated in the voltage converter control. In that manner, the open-loop and/or closed-loop control can be carried out centrally and all measurements and error conditions are able to result in reactions at the respectively correct point.

The voltage converter can have an inverter that generates a pulse-shaped bipolar voltage, and a resonant circuit that is connected downstream of the inverter and that converts the pulse-shaped voltage into a sinusoidal voltage. In that manner, high frequencies of the pulse-shaped bipolar voltage are not passed to the output. This reduces the interference radiation of the generator.

The VPG can have an error condition diagnosis device. Error conditions can be determined by monitoring the output quantities: for example, an arc in the plasma can be detected. It is also possible, however, for internal error conditions to be detected, for example, by humidity sensors or by temperature sensors. It is also possible to monitor the internal d.c. voltage at the output of the converter. The VPG can have an indicating device that indicates these error conditions.

If a memory device is provided, the error conditions can be stored in the VPG and indicated for diagnostic purposes. The error conditions can be capable of being read out through remote control line connectors.

The error conditions in the VPG can be passed to the connector to the remote control line; in that manner, the central control is able to evaluate the error conditions.

The error condition diagnosis device can be integrated in the voltage converter device and can use the digitized data of the measuring device. It is thus possible to react to the error conditions in a suitable manner, for example, to restrict or reduce the output of the VPG, switch off the VPG completely or for a short time, or control the voltage converter in such a way that the error condition, for example, an arc in the plasma, is eliminated as quickly as possible and with as little energy as possible being supplied.

Having described the general principles of the new VPGs, we will now describe certain exemplary embodiments.

Exemplary Embodiments

FIG. 1 shows a vacuum plasma generator (VPG) 1 including a shield 14 in the form of a metallic housing. The shield 14 offers some amount of protection to components within the VPG 1 against mechanical loads and against high frequency radiation from the surroundings, and further protects the region surrounding the VPG 1 against high frequency radiation. Thus, the shield 14 can be a housing that entirely encloses all of the components of the VPG 1, or the shield 14 can be a housing that encloses a subset of the components of the VPG 1 as needed for protection.

The shield 14 has sufficiently small openings for coupling to devices outside of the shield 14. The openings in the shield 14 are designed to be less than one tenth of the wavelength of the frequency that is to be attenuated by the shield 14. Thus, the size of the openings in the shield 14 should be reduced if the shield 14 is to provide attenuation of higher frequencies (smaller wavelengths). For example, the shield 14 can have housing doors or detachable openings by means of spring contact strips. Opening for ventilation in the shield 14 can be perforated plates having small holes.

The VPG 1 is disposed on a plasma chamber 5 of a vacuum plasma system. The plasma chamber 5 has an electrode holder 4 in which one or more electrodes 3 are mounted. The VPG 1 has an output connector 2 to which the electrodes 3 are connected by way of an electrical connection 22. The connection 22 is shown as being short in FIG. 1 since the VPG 1 is mounted directly on top of the electrode holder 4. In addition, the connection 22 has a shielding 43 and a low impedance to high frequency connection 44 from that shielding 43 to a connector 21 on the shield 14. The shield 14 also includes a connection element 16, which may be a metallic guide and/or a screwed connection, and the electrode holder 4 includes a connection element 160 that is sized to mate with the connection element 16 of the shield 14, thereby providing a connection device for coupling the shield 14 to the electrode holder 4 and to the plasma chamber 5. The VPG 1 can be mounted on the electrode holder 4 by coupling the connection elements 16, 160. The shield 14 encloses a mains input filter 13, a mains rectifier 8, a voltage converter 9, and a voltage converter control 11 that controls the voltage converter 9.

The VPG 1 includes a mains connector 6 for connection to the mains power supply 7. The mains power supply 7 can be an a.c. voltage network having various frequencies, for example, 50 or 60 Hz. Harmonics on the mains connector 6 can be rectified by the mains rectifier 8 so as not to lead to interference in the VPG 1. In another implementation, the mains power supply 7 can be a d.c. voltage network. In this case, the mains rectifier 8 provides some protection against reverse connection. The mains rectifier 8 can perform rectification with harmonic suppression, for example, power factor correction (PFC), to reduce harmonics on the mains power supply 7. Alternatively or additionally, such harmonic suppression can be included upstream or downstream of the mains rectifier 8.

The VPG 1 also includes a protective ground conductor connector 17 for connection to a protective ground conductor 18. The ground conductor connector 17 can also act as a low-impedance protective earth conductor connector to effectively attenuate low-frequency interference in a range up to about 10 kHz.

The voltage converter 9 includes a voltage converter control input 10 and an electrical isolation device 12. The electrical isolation device 12 electrically separates the mains connector 6 from the output connector 2. The electrical isolation device 12 reduces or prevents the formation of ground loops that may cause interference within the VPG 1. The electrical isolation device 12 can be any suitable device that provides an effective separation or attenuation of high-frequency signals, that is, signals having frequencies greater than the operating frequency of the VPG 1. If the VPG is a medium frequency generator, it would operates at about 10-500 kHz. In this way, the useful frequency can be transmitted to the output connector 2 while the high-frequency interference frequency can be effectively suppressed. For example, the electrical isolation device 12 can be a transformer.

The mains input filter 13 is connected to the shield 14 by way of a low impedance to high frequency connection 15. The mains input filter is advantageously mounted very close to the shield. The mains input filter 13 protects against high-frequency interference from the mains power supply 7 and from the surroundings that can be coupled into the mains connector 6. The mains input filter 13 can be constructed in a variety of ways. For example, the mains input filter can have inductors in series with the mains connector 6 and also capacitors and/or surge diverters to a ground potential. The mains input filter 13 also attenuates interference from the VPG 1 and prevents or reduces the possibility that such interference would lead to interference in the mains power supply 7 and would radiate into the surroundings from the mains connector 6. The mains input filter 13 can be mounted very close to the shield 14 to improve the interference protection.

The VPG 1 includes a connector 19 that provides a low impedance to high frequency connection of the shield 14 to the electrode holder 4 at the connector 20. In another implementation, the connection elements 16, 160 may act as a low impedance to high frequency connection between the shield 14 and the electrode holder 4.

The VPG 1 also has a converter 40 having a converter control input 39 for control by a converter control 38 that, in the illustrative embodiment shown, is part of the voltage converter control 11. The voltage converter control 11 includes a digital programmable logic device 23, which, in some embodiments, is a DSP (digital signal processor); and a memory device 24 in which, for example, error conditions may be stored for diagnostic purposes.

The VPG 1 includes a plurality of connectors 25, 27, 29 for remote control. The connector 25 couples a digital remote control line 26 to the voltage converter control 11 and the connector 25 is coupled to an electrical isolation device 36 in the shield 14. The electrical isolation device 36 can be a galvanic isolation device that electrically separates the digital remote control line 26 from the voltage converter control 11. The connector 27 couples a digital remote control line 28 to the voltage converter control 11 and the connector 27 is coupled to a filter device 37 of the shield 14. The remote control lines 26, 28 may be CAN bus, Profibus, RS232, RS485, or other digital bidirectionally operable bus systems.

In some implementations, the serial bus systems of the remote control lines 26, 28 may be optically transmitted through optical waveguides. In this case, the connectors 25, 27 would be designed as optical connectors, making it is feasible to dispense with the separate electrical isolation device 36 and the filter device 37.

The connector 29 serves to connect an analog remote control line 30 to the voltage converter control 11. As shown, the remote control line 30 includes a shielding 33. The shielding 33 may be coupled by means of a low impedance to high frequency connection 32 to a connector 31. The connector 29 is coupled to the voltage converter control 11 through a filter 34 and an analog-to-digital converter 35 (A/D converter). The connector 29 can be bidirectional.

The VPG 1 also has a measuring device 42 and a downstream filter 41 between the voltage converter control 11 and the voltage converter 9. The VPG 1 includes an indicating device 47 coupled to the voltage converter control 11, and a fault diagnosis device 48 that is integrated within the voltage converter control 11.

The measuring device 42 monitors output quantities such as output voltage, output current, and/or output power that are sent to the output connector 2. The measuring device 42 is within the shield 14 and it digitizes the output quantities and passes them through the filter 41 to the voltage converter control 11. The filter 41 can be used to suppress high-frequency interference in the signals sent to the voltage converter control 11. Moreover, the output quantities to the output connector 2 can be controlled in a closed loop using the indicating device 47 (coupled to the voltage converter control 11) and/or the remote control line 30, and these output quantities can be stored within the memory device 24 of the voltage converter control 11 for later evaluation and diagnosis.

Figure 2A:
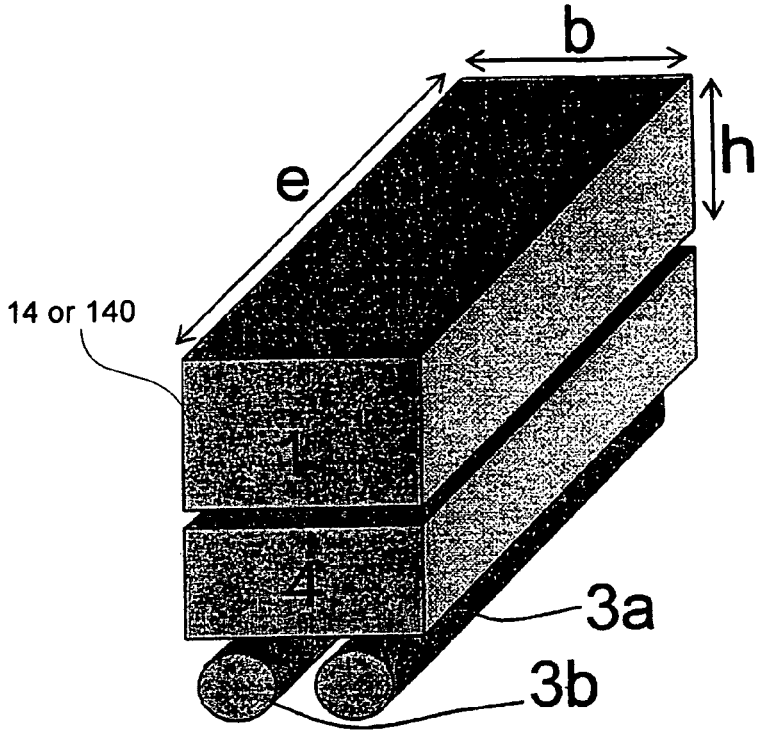
FIGS. 2*a* and 2*b* are perspective views of, respectively, second and third embodiments of a vacuum plasma generator with electrodes and an electrode holder.
Figure 2B:
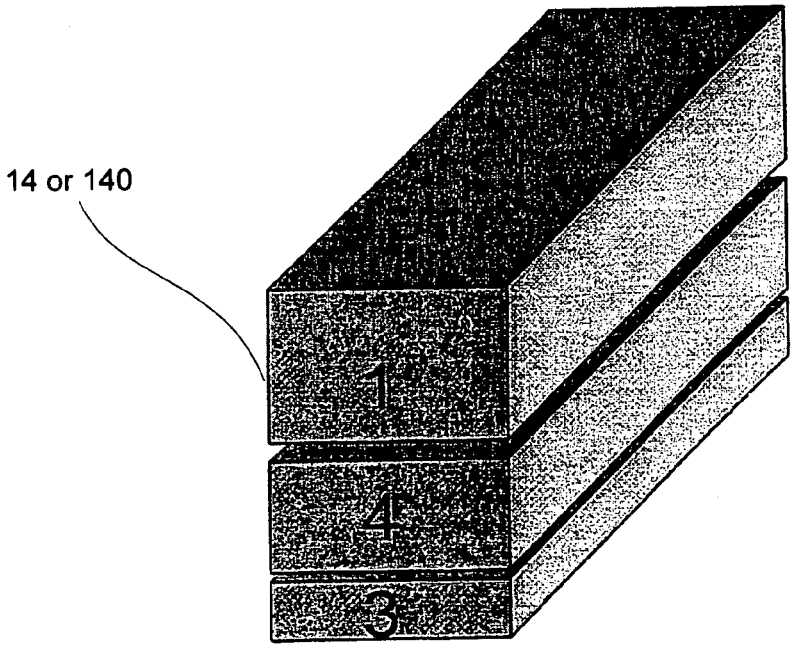

FIG. 2*a* and FIG. 2*b* are intended to explain once more an embodiment of the VPG 1 having electrodes 3, 3*a*, 3*b* and the electrode holder 4. In FIG. 2*a*, the VPG 1 is mounted by way of the housing 140 or the shield 14 directly on top of the electrode holder 4 on which are mounted two electrodes 3*a*, 3*b* that are cylindrical in this particular embodiment. The VPG 1 has a length e that is matched to the length of the electrode holder 4 and that is usually in the range from about 2.5 to about 3.5 m, and a width b that is matched to the width of the electrode holder 4 and that is in the range from about 70 to about 80 cm. The height h of the VPG 1 can be selected independently of the size of the electrode holder 4. In FIG. 2*b*, the VPG 1 is mounted by way of the housing 140 or the shield 14 directly on top of the electrode holder 4 on which a planar (that is, a flat) electrode 3 is mounted. In this case, the planar electrode 3 has a width that is matched to the width of the electrode holder 4.

Figure 3:
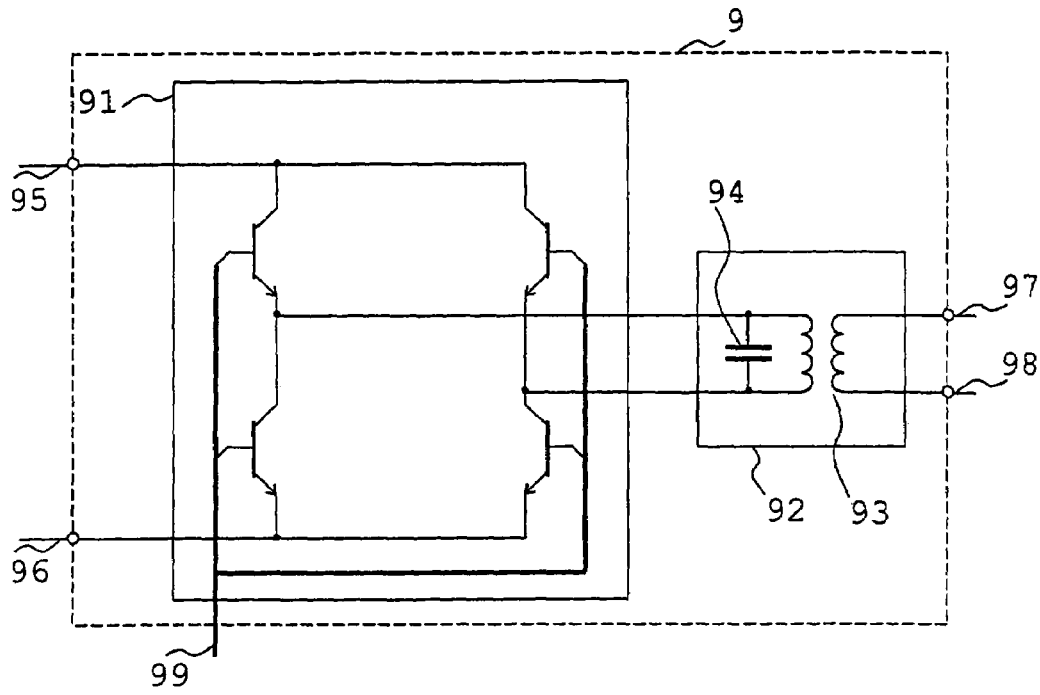
FIG. 3 is a schematic diagram of an embodiment of a voltage converter for use in the vacuum plasma generators of FIGS. 1, 2*a*, and 2*b*.

FIG. 3 shows an embodiment for a voltage converter 9 of the type used for VPG 1 operating at a medium frequency. The voltage converter 9 includes two input connectors 95, 96 that couple to an output of the converter 40. The positive potential of the d.c. voltage couples to the connector 95 and the negative potential of the d.c. voltage couples to the connector 96. The voltage converter 9 further has an inverter 91 that couples to a connector for receiving control signals 99 from the voltage converter control 11.

In addition, the voltage converter 9 has a resonant circuit 92 that in turn has a capacitor 94 and a transformer 93. The leakage inductance of the transformer 93 forms the inductance for the resonant circuit 92. Moreover, the transformer 93 acts as the electrical isolation device 12 that ensures galvanic isolation between the mains connector 6 and the output connector 2. The isolation provided by the transformer 93 can have as low a capacitance as possible so as not to allow interference from the surroundings having very high frequencies to reach the inverter 91. In the illustrative embodiment, the coupling capacitance of the capacitor 94 is about 200-500 pF. The voltage converter 9 further has two output connectors 97 and 98 that feed a medium frequency signal to the output connector 2.

The inverter 91 generates a pulse-shaped bipolar voltage, and the resonant circuit 92, connected downstream of the inverter 91, converts the pulse-shaped voltage into a sinusoidal voltage. In that manner, high frequencies of the pulse-shaped bipolar voltage are not passed to the output of the voltage converter 9, thus reducing the interference radiation of the VPG 1.

Other implementations are within the scope of the following claims. For example, the VPG 1 can be formed with more than one shield 14, with each shield 14 surrounding a particular component of the VPG 1. In either case, the VPG 1 can include an additional housing 140 (shown in FIG. 1) that surrounds the shield 14 and any components not within the shield 14.

What is claimed is:

1. A vacuum plasma generator having an output connector for electrical connection to at least one electrode of a plasma chamber, wherein the vacuum plasma generator comprises:

a mains connector for connection to a mains power supply, a mains input filter coupled to the mains connector, a voltage converter coupled to the mains input filter and including an output signal, a shield that surrounds at least the voltage converter, the mains connector, and the mains input filter, and a connection device that provides an electrical connection between the shield and the plasma chamber.

2. The vacuum plasma generator of claim 1, wherein the connection device is configured for connection of the shield to the plasma chamber over the surface area of the shield.

3. The vacuum plasma generator of claim 1, wherein the shield includes a connection device that connects to an electrode holder of the plasma chamber.

4. The vacuum plasma generator of claim 3, wherein the connection between the electrode holder of the plasma chamber and the shield includes a mechanical connection.

5. The vacuum plasma generator of claim 3, wherein the connection between the electrode holder of the plasma chamber and the shield includes an electrical connection.

6. The vacuum plasma generator of claim 3, wherein the size of the vacuum plasma generator is similar to the size of the plasma chamber or the electrode holder.

7. The vacuum plasma generator of claim 3, wherein the size of the vacuum plasma generator is similar to the size of the electrode holder and includes connection elements for mounting of the vacuum plasma generator directly to the electrode holder.

8. The vacuum plasma generator of claim 1, wherein the mains input filter is connected to the shield, and the vacuum plasma generator includes a protective ground conductor connector that is connected to the shield.

9. The vacuum plasma generator of claim 8, wherein the mains input filter is connected to the shield by way of a low impedance to high frequency connection.

10. The vacuum plasma generator of claim 1, wherein the shield includes a connector for a connection to a connector on the plasma chamber.

11. The vacuum plasma generator of claim 10, wherein the connection between the shield and the electrode holder connector is a low impedance to high frequency connection.

12. The vacuum plasma generator of claim 10, wherein the shield connector connects to a connector on an electrode holder of the plasma chamber.

13. The vacuum plasma generator of claim 12, further comprising a low impedance to high frequency connection between the electrode holder and the plasma chamber.

14. The vacuum plasma generator of claim 1, further comprising a connector device for mechanical connection to the plasma chamber.

15. The vacuum plasma generator of claim 1, wherein the connection device forms a low impedance to high frequency connection between the shield and an electrode holder of the plasma chamber.

16. The vacuum plasma generator of claim 1, further comprising an electrical connection between the output connector to at least one electrode of the plasma chamber, wherein the electrical connection is short enough to reduce interference in a plasma system that includes the plasma chamber.

17. The vacuum plasma generator of claim 16, wherein the electrical connection is shorter than about 2 meters.

18. The vacuum plasma generator of claim 1, wherein the voltage converter control is in the form of a digital control and includes a programmable digital logic device.

19. The vacuum plasma generator of claim 1, further comprising at least one connector for a digital remote control line.

20. The vacuum plasma generator of claim 19, wherein the connector for the digital remote control line is connected to the voltage converter control.

21. The vacuum plasma generator of claim 20, wherein the connection between the digital remote control line connector and the voltage converter control includes a filter that is connected to the shield with low impedance to high frequency.

22. The vacuum plasma generator of claim 21, wherein the filter suppresses interference from entering and exiting the vacuum plasma generator.

23. The vacuum plasma generator of claim 19, wherein the connection of the connector for the digital remote control line to the voltage converter control includes a galvanic isolation device.

24. The vacuum plasma generator of claim 19, wherein the connector for the digital remote control line includes an optical connector and the digital remote control line includes an optical waveguide.

25. The vacuum plasma generator of claim 19, wherein the connector for the digital remote control line is bidirectional and data transfer to and from the voltage converter control through the remote control line is provided through the connector.

26. The vacuum plasma generator of claim 1, further comprising a connector that couples to external analog remote control signals and an A/D converter within the shield and connected to the connector for digitizing the external analog signals, wherein the A/D converter is connected to the voltage converter control.

27. The vacuum plasma generator of claim 1, further comprising a measuring device that monitors output quantities of the output connector, wherein the measuring device is disposed inside the shield and is configured to digitize the output quantities and pass them to the voltage converter control.

28. The vacuum plasma generator of claim 27, wherein the measuring device includes one or more filters that are configured to suppress high-frequency interference.

29. The vacuum plasma generator of claim 1, further comprising a transformer that provides galvanic isolation between the main connector and the output connector.

30. The vacuum plasma generator of claim 1, further comprising a converter connected downstream of the mains rectifier, wherein the converter includes a converter control input for connection to a converter control and the output of the converter is connected to the voltage converter.

31. The vacuum plasma generator of claim 30, wherein the converter includes a boost converter, a buck converter, or both a boost converter and a buck converter.

32. The vacuum plasma generator of claim 30, wherein the converter control is integrated in the voltage converter control.

33. The vacuum plasma generator of claim 1, wherein the voltage converter includes:

an inverter that generates a pulse-shaped alternating current voltage, and a resonant circuit that is connected downstream of the inverter and that converts the pulse-shaped voltage into a sinusoidal voltage.

34. The vacuum plasma generator of claim 1, further comprising an error condition diagnosis device and an indicating device that indicates error conditions.

35. The vacuum plasma generator of claim 34, further comprising a memory in which the error conditions may be stored and read out for diagnostic purposes and indicated on the indicating device or read out by way of remote control line connectors.

36. The vacuum plasma generator of claim 34, wherein the error condition diagnosis device is integrated in the voltage converter control and the digitized data of the measuring device are fed to the error condition diagnosis device.

37. The vacuum plasma generator of claim 1, wherein the voltage converter comprises a voltage converter control input for connection to a voltage converter control.

38. The vacuum plasma generator of claim 1, wherein the connection device is a low impedance to high frequency connection.

39. The vacuum plasma generator of claim 1, wherein the shield is a metallic housing.

40. The vacuum plasma generator of claim 1, wherein the shield surrounds all components of the vacuum plasma generator.

41. A method of generating power to a plasma chamber having at least one electrode, the method comprises:

coupling a mains connector to a mains power supply, coupling a mains input filter to the mains connector, coupling a voltage converter to the mains input filter, producing an output signal at the voltage converter to send power to the plasma chamber, surrounding at least the voltage converter, the mains connector, and the mains input filter with a shield, and providing an electrical connection between the shield and the plasma chamber.

42. A method of making a vacuum plasma generator having an output connector for electrical connection to at least one electrode of a plasma chamber, wherein the method comprises:

coupling a mains input filter to a mains connector that is configured to be linked to a mains power supply, coupling a voltage converter to the mains input filter, surrounding at least the voltage converter, the mains connector, and the mains input filter with a shield, and providing a connection device at the shield that is configured to provide an electrical connection between the shield and the plasma chamber.

* * * * *

UNITED STATES PATENT AND TRADEMARK OFFICE

CERTIFICATE OF CORRECTION

PATENT NO. : 7,586,099 B2
APPLICATION NO. : 11/396354
DATED : September 8, 2009
INVENTOR(S) : Thorsten Eyhorn et al.

It is certified that error appears in the above-identified patent and that said Letters Patent is hereby corrected as shown below:

On the title page item (75), delete "Gerhard Zahringer" and insert --Gerhard Zaehringer--.

Signed and Sealed this

Twelfth Day of January, 2010

David J. Kappos

David J. Kappos
*Director of the United States Patent and Trademark Office*